US006280234B1

(12) United States Patent
Yamamoto et al.

(10) Patent No.: US 6,280,234 B1
(45) Date of Patent: Aug. 28, 2001

(54) WIRE SHAKING PREVENTION STRUCTURE OF CONNECTOR

(75) Inventors: Masaya Yamamoto; Kenji Suzuki; Satoshi Yamada, all of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/544,554

(22) Filed: Apr. 6, 2000

(30) Foreign Application Priority Data

Apr. 9, 1999 (JP) ..... 11-102207

(51) Int. Cl.[7] ..... H01R 13/58
(52) U.S. Cl. ..... 439/456; 439/752
(58) Field of Search ..... 439/752, 404, 439/405, 596, 459, 456, 460

(56) References Cited

U.S. PATENT DOCUMENTS 4,367,005 * 1/1983 Douty et al. ..... 439/459
5,520,550 * 5/1996 Okabe ..... 439/456

FOREIGN PATENT DOCUMENTS 55-92285 12/1953 (JP) .

* cited by examiner

*Primary Examiner*—Gary Paumen
(74) *Attorney, Agent, or Firm*—Sughrue, Mion, Zinn, Macpeak & Seas, PLLC

(57) ABSTRACT

A plurality of rows (stages) of wire receiving portions (13, 14) are formed in a connector housing (1), and are arranged in a stepped manner in a direction of a length of the wires, and a plurality of rows (stages) of wire-pressing projections (8, 9) are formed on the spacer (7), and are offset from each other in the direction of the length of the wires, and each row of wires are pressed against a corresponding wall portion (11, 12), extending from the corresponding row of wire receiving portions, by the corresponding row of projections, respectively. The first row of wire receiving portions (14) are provided at an inlet side of a spacer receiving portion (3), and the second row of wire receiving portions (13) are provided at an inner side of the spacer receiving portion, and are longer than the first row of wire receiving portions, and the projections (9) are opposed to a step wall portion (12*a*) formed between the first and second rows of wire receiving portions, and the projections (8) are opposed to the wall portion (11). Formed on a base wall portion (27) of the spacer (7), and terminal receiving portions (31) are formed in the spacer, and are offset from the projections (9) in the direction of the length of the wires. The projections (8) are formed on the outer wall portion (29) of the terminal receiving portions. Terminal-retaining projected portions (35–38) are formed on the base wall portion (27) and the outer wall portion (29). Each of the projections (8, 9) has slanting surfaces (8*a*–9*b*) or an arcuate surface for preventing damage to the wire. A terminal support portion (18) is provided within the spacer receiving portion in the connector housing.

15 Claims, 4 Drawing Sheets

Fig. 4
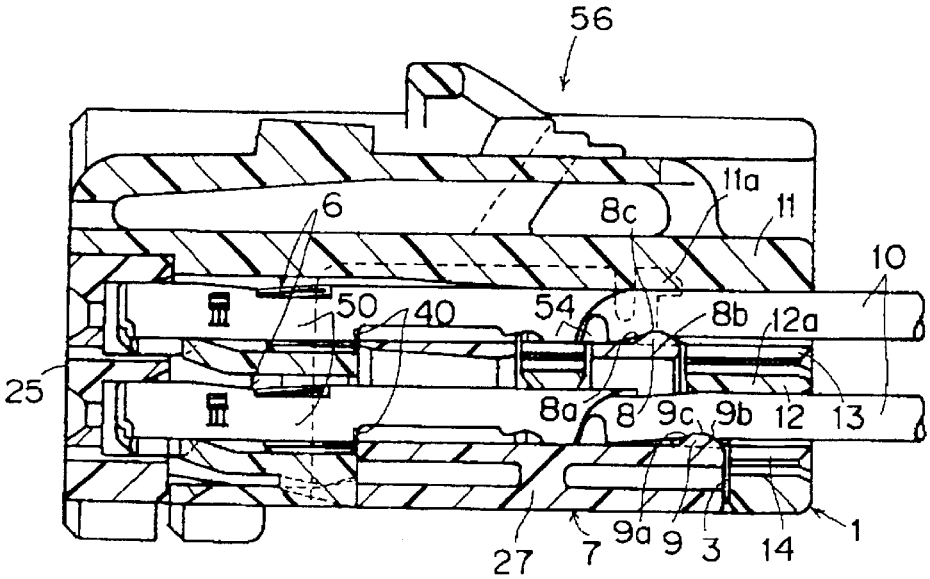
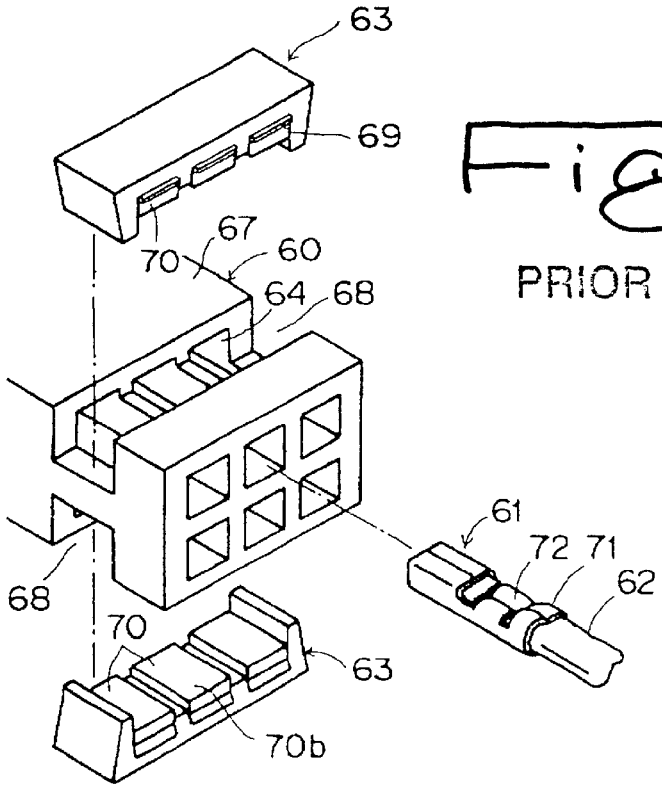
Fig. 5
PRIOR ART

WIRE SHAKING PREVENTION STRUCTURE OF CONNECTOR

BACKGROUND OF THE INVENTION

1. Field of the Invention

The present invention relates to a structure of preventing the shaking of wires in a connector, in which a spacer is inserted into a connector housing to effect the retainment of terminals and the pressing of the wires simultaneously.

The present application is based on Japanese Patent Application No. Hei. 11-102207, which is incorporated herein by reference.

2. Description of the Related Art

FIGS. 5 and 6 show a related wire shaking prevention structure of a connector disclosed in Unexamined Japanese Utility Model Publication No. Sho. 55-92285.

In this structure, female terminals 61, each connected to a wire 62, are inserted into a connector housing 60 of the male type, and the terminals 61 are retained at their rear ends by terminal double-retaining spacers 63, and at the same time the wires 62 are pressed by the spacers 63 to be fixed.

The connector housing 60 is made of a synthetic resin, and has a plurality of terminal receiving chambers 64 arranged in two (upper and lower) rows. The terminals 61 are inserted respectively in the upper and lower terminal receiving chambers 64, and the upper terminals 61 are disposed back to back with the lower terminals 61, respectively. Each terminal 61 is retained relative to a step portion of a partition wall 66 of the connector housing 60 through an elastic retaining piece portion 65 (FIG. 6).

Spacer insertion openings 68 are. formed respectively in upper and lower walls 67 of the connector housing 60, and are disposed intermediate opposite ends of the connector housing 60. The spacers 63 are inserted respectively into the openings 68 in a direction perpendicular to the terminal-inserting direction, and are retained at retaining projections 69 to the edges of the openings 68, respectively.

The spacer 63 is made of a synthetic resin, and has terminal-retaining/wire-pressing wall portions 70 for projecting into the terminal receiving chambers 64. The rear end of the terminal 61 is abutted against a vertical front end surface 70*a* of the wall portion 70, and the wire 62 is pressed in a radial direction by a horizontal surface 70*b* of the wall portion 70. The rear end of the terminal 61 defines rear ends of pressclamping piece portions 71 pressed to clamp an insulating sheath of the wire 62. A conductor of the wire 62 is press-clamped by press-clamping piece portions 72.

The purpose of pressing the wire 62 by the spacer 63 is to prevent the shaking of the wire 62 due to vibrations of a vehicle and so on so as to prevent the terminal 61 and the wire 62 from finely shaking in unison or being displaced in the longitudinal and radial directions and also to prevent the female terminal 61 of the connector 73 (FIG. 6) from moving in sliding contact with a male terminal in a mating connector (not shown) so as to prevent wear of these terminals and also to prevent the contact between the terminals from being adversely affected. Particularly, recently, the number of circuits, used in a vehicle, has increased, and also connectors and terminals have small-size designs, and as a result the load of contact between terminals tends to be reduced, and therefore there is a possibility that the contact between the terminals is rendered unstable by vibrations of the vehicle and so on. In order to overcome this problem, the wires 62 need to be positively pressed to be fixed.

In the above structure, however, the wall portion 70 of the spacer 63 serves to retain the terminal 61 and also to press the wire 62, and therefore the front and rear ends of the wall portion 70 have sharp edges, respectively, and there has been a possibility that the wire 62 is damaged by these edges. If the edge of the front end of the wall portion 70 is removed by chamfering or the like, damage to the wire 62 is prevented, but the area of contact of this front end with the rear end of the terminal 61 is reduced, thus inviting a problem that the force to retain the terminal 61 decreases. And besides, the flat surface 70*b* of the wall portion 70 of the spacer 63 is held in surface contact or line contact with the surface of the wire 62 along the length of the wire, and therefore pressing force is small, thus inviting a problem that the wire 62 is not sufficiently fixed against intense vibrations and the pulling and bending of the wire 62.

Furthermore, the spacer 63 is needed for each of the upper and lower rows of terminals 61 in the connector housing 60, and therefore there has been encountered a problem that the number of the spacers 63, as well as the time and labor for the assembling operation, increases. And besides, the upper row of terminals 61 and the lower row of terminals 61 must be arranged back to back with each other, and therefore there has been encountered a problem that this structure is not suited for the type of connector in which the upper and lower rows of terminals 61 are arranged to face in the same direction, that is, the upper and lower rows of terminals are arranged to face upwardly or downwardly.

SUMMARY OF THE INVENTION

With the above problems in view, it is an object of the present invention to provide a wire shaking prevention structure of a connector in which wires, connected respectively to terminals arranged in a plurality of rows (stages) within a connector housing, are positively pressed by a spacer without being damaged, thereby positively preventing the shaking of the wires and terminals due to vibrations of a vehicle and so on, and the number of the spacer, as well as the time and labor for the assembling operation, is reduced, and besides the upper and lower terminals within the connector housing are arranged to face in the same direction.

To achieve the above object, according to the first aspect of the present invention, there is provided a wire shaking prevention structure of a connector in which terminals, respectively connected to wires, are inserted in a plurality of rows into a connector housing of the connector, and a spacer is inserted into the connector housing to effect retainment of the terminals and pressing of the wires simultaneously, the structure which comprises a plurality of rows of wire receiving portions formed in the connector housing, the wire receiving portions being arranged in a stepped manner in a direction of length of the wires, a plurality of rows of wire-pressing projections formed on the spacer, the wire-pressing projections being offset from each other in the direction of the length of the wires, and a corresponding wall portion extending from a corresponding row of the wire receiving portions, wherein each row of the wires is pressed against the corresponding wall portion by a corresponding row of the projections.

Further, according to the second aspect of the present invention, it is preferable that a first row of the wire receiving portions is provided at an inlet side of a spacer receiving portion formed in the connector housing, and a second row of the wire receiving portions is provided at an inner side of the spacer receiving portion, and is longer than the first row of the wire receiving portions, and a first row of the projections is opposed to a step wall portion formed between the first and second rows of the wire receiving portions, and a second row of the projections is opposed to the wall portion extending from the second row of the wire receiving portions.

Further, according to the third aspect of the present invention, it is preferable that the first row of the projections is formed on a base wall portion of the spacer, and a plurality of terminal receiving portions are formed in the spacer, and are offset from the first row of the projections in the direction of the length of the wires, and the second row of the projections is formed on an outer wall portion of the terminal receiving portions.

Further, according to the fourth aspect of the present invention, it is preferable that a plurality of terminal-retaining projected portions are formed on the base wall portion and the outer wall portion.

Further, according to the fifth aspect of the present invention, it is preferable that each of the projections has one of a plurality of slanting surfaces and an arcuate surface for preventing damage to the wires.

Further, according to the sixth aspect of the present invention, it is preferable that a terminal support portion is provided within the spacer receiving portion of the connector housing.

BRIEF DESCRIPTION OF THE DRAWINGS

FIG. 4 is a vertical cross-sectional view of the connector, showing the spacer in its completely-retained condition;

FIG. 5 is an exploded, perspective view of a relate d structure; and

DETAILED DESCRIPTION OF THE PREFERRED EMBODIMENT

Figure 1:
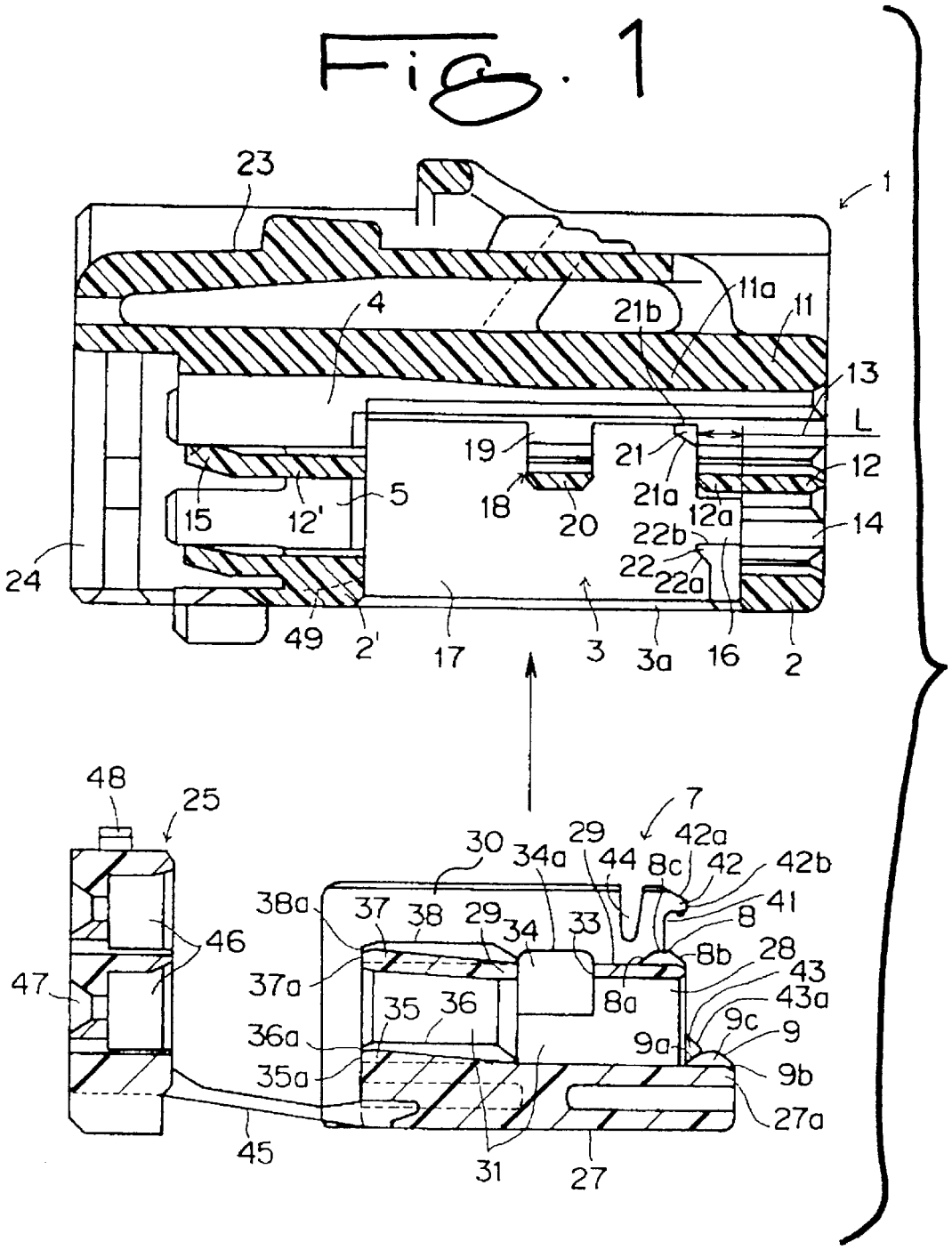
FIG. 1 is a vertical cross-sectional view showing a wire shaking prevention structure of a connector forming one preferred embodiment of the present invention.

A preferred embodiment of the present invention will now be described in detail with reference to the drawings.

FIGS. 1 to 4 show a wire shaking prevention structure of a connector forming one preferred embodiment of the present invention.

In this structure, a spacer insertion opening (spacer receiving portion) 3 is formed in a bottom wall 2 (2') of a male-type connector housing 1 of a synthetic resin in a direction perpendicular to a terminal-inserting direction, and one spacer 7 of a synthetic resin is inserted into the opening 3, and is provisionally retained relative thereto. Terminals 6 (FIG. 3), connected respectively to wires, are inserted respectively into tow (upper and lower) rows (stages) of terminal receiving portions (chambers) 4 and 5 within the connector housing 1, and are disposed to face downwardly. When the spacer 7 is shifted from the provisionally-retained position to a completely-retained position, the terminals 6 are retained by the front end of the spacer 7, and the upper row of wires 10 are pressed against an upper wall 11 of the connector housing 1 respectively by an upper row of pressing projections 8 on a rear end of the spacer 7 while the lower row of wires 10 are pressed against a lower wall 12 of the connector housing 1 respectively by a lower row of pressing projections 9 on the rear end of the spacer 7. The upper row of pressing projections 8 are offset from the lower row of pressing projections 9 in a forward-rearward direction (that is, a terminal-inserting/withdrawing direction).

As shown in FIG. 1, the connector housing 1 has the two (upper and lower) rows of terminal receiving portions 4 and 5, disposed on the front side of the spacer insertion opening 3, and also has wire receiving portions 13 and 14 disposed on the rear side of the opening 3. Elastic retaining lances 15 for primarily retaining the terminals are formed integrally on a bottom wall 12' of the upper terminal receiving portions 4, and also elastic retaining lances 15 are formed integrally on the bottom wall 2' of the lower terminal receiving portions 5.

The lower wire receiving portions 14 are notched (as at 16) at their front portions, and therefore have a smaller length, and the upper wire receiving portions 13 are longer forwardly by an amount corresponding to the length (step) L of the notch 16. The thin bottom wall (wall portion) 12 of the upper wire receiving portions 13 extends forwardly beyond the thick bottom wall 2 of the lower wire receiving portions 14, and a step portion, having the length L, is formed by this extension wall portion (step wall portion) 12*a*. This wall portion 12*a* extends forwardly beyond the lower wire receiving portions 14. The bottom wall 12 serves also as a partition wall between the upper and lower wire receiving portions 13 and 14. The lower bottom wall 2 extends to an inlet 3*a* of the opening 3.

The upper wall (wall portion) 11 of the upper wire receiving portions 13 serves also as a thick upper wall of the connector housing 1, and the upper wall 11 extends long forwardly beyond the wire receiving portions 13. The opening 3 extends upwardly from the lower bottom wall 2 (2') to a generally-central portion of each upper terminal receiving portion 4 in the direction of the height thereof. Notches (not shown) of a rectangular shape are formed respectively in opposite (right and left) side walls 17 of the connector housing 1, and extend upwardly to a level disposed generally centrally of the thickness of the upper wall 11, and these notches are continuous with the opening 3.

Terminal support portions 18 of an L-shape or an inverted U-shape for preventing the dropping of the terminals, are provided in the opening 3, and are disposed at a generally-central portion of the opening 3 in the forward-rearward direction, and extend downwardly from the upper side of the opening 3 to a level equal to the height of the bottom wall 12 of the upper wire receiving portions 13. The terminal support portion 18 has a vertical wall portion 19, directed toward the inlet 3*a* of the opening 3, and a horizontal wall portion 20 disposed at the same level as that of the bottom wall 12 of the wire receiving portions 13, and the terminal 6 can be supported by an upper surface of the wall portion 20.

Spacer-retaining projections 21 are formed on and project inwardly respectively from the opposite side walls 17 of the connector housing 1 into the opening 3, and are disposed forwardly of the upper wire receiving portions 13. The projection 21 has a downwardly-directed slanting guide surface 21*a* and an upwardly-directed horizontal retaining surface 21*b*. Spacer-retaining projections 22 are formed on and project inwardly respectively from the opposite side walls 17, and are disposed forwardly of the lower wire receiving portions 14, the projections 22 being disposed below the projections 21 The projection 22 has a downwardly-directed slanting guide surface 22*a* and an upwardly-directed horizontal retaining surface 22*b*.

A lock arm 23 for a mating connector housing (not shown) of the female type is formed on the upper wall 11 of the connector housing 1. A front opening 24, communicating with the terminal receiving portions 4 and 5, is formed in the front end of the connector housing 1. A front holder 25, made of a synthetic resin, is fitted into the front opening 24.

The spacer 7 includes a base wall portion 27 for closing the inlet 3*a* of the opening 3, with its outer surface lying flush with the outer surface of the bottom wall 2 (2') of the connector housing 1, a plurality of juxtaposed partition walls 28 (FIG. 2) which are formed on the base wall portion 27, and form extension portions (terminal receiving chambers 31) of the lower terminal receiving portions 5, respectively, a horizontal upper wall portion (outer wall portion) 29 which interconnects the partition walls 28 at their upper ends, and is disposed parallel to the base wall portion 27, and a pair of side plate portions 30 and 30 extending upwardly from opposite side edges of the base wall portion 27, respectively.

The base wall portion 27 extends slightly rearwardly beyond the upper wall portion 29, and the pressing projections 9 for the lower wires 10 (each having the terminal) in the connector housing 1 are formed on an upper surface of this extension portion 27*a*. The pressing projections 8 for the upper wires 10 (each having the terminal) in the connector housing 1 are formed on an upper surface of the upper wall portion 29 at a rear end thereof.

Each of the projections 8 and 9 has a generally trapezoidal cross-section, and has front and rear tapering slanting surfaces 8*a* and 8*b*, 9*a* and 9*b*, and a horizontal, narrow top surface 8*c*, 9*c* extending between the front and rear slanting surfaces 8*a* and 8*b*, 9*a* and 9*b*. The top surface 8*c*, 9*c* is smaller in area than the slanting surfaces 8*a*, 8*b*, 9*a* and 9*b*. Each of the projections 8 and 9 can be formed into an arcuate cross-section or a semi-spherical shape.

The upper projections 8 are offset from the lower projections 9 in the forward-rearward direction by a distance corresponding to the length L of the step portion of the connector housing 1.

The lower projections 9 are opposed to the step wall portion 12*a* of the upper wall (serving as the bottom wall or partition wall of the upper wiring receiving portions 13) 12, and the upper projections 8 are opposed to a front extension portion 11*a* of the upper wall 11 of the upper wiring receiving portions 13.

Figure 2:
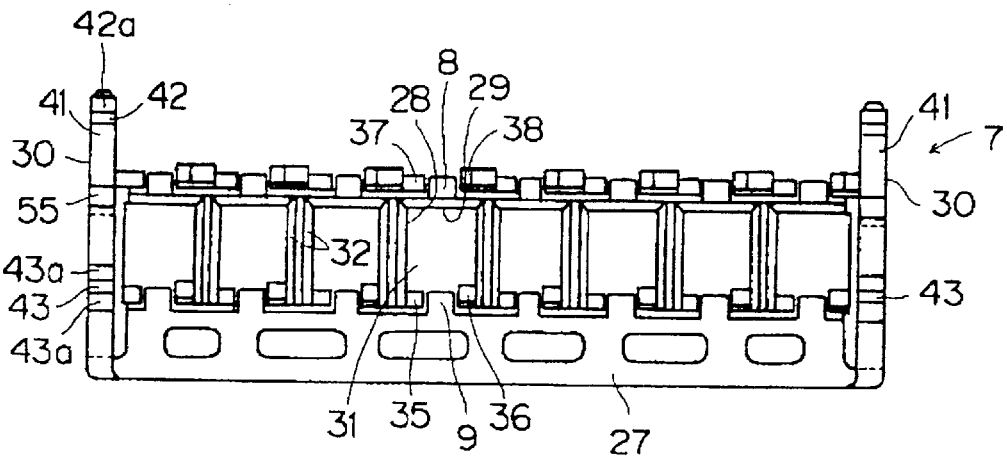
FIG. 2 is a rear view of a spacer.

As shown in FIG. 2, the projections 9, formed on the base wall portion 27, are disposed respectively in vertical planes in which the centerlines (axes) of the terminal receiving portions 31 lie, respectively, and the projections 8, formed on the upper wall portion 29, are disposed respectively in these vertical planes. The rear ends of the partition walls 28 are disposed in laterally-spaced relation to the front ends of the lower projections 9. Guide chamfers 32 are formed on the rear ends of the partition walls 28 and the rear end of the upper wall portion 29. The partition walls 28, the base wall portion 27 and the upper wall portion 29 jointly form the hollow terminal receiving portions 31 of a rectangular transverse cross-section. The two partition walls 28, provided respectively at the opposite ends of the spacer 7, are integral with the opposite side plate portions 30, respectively.

As shown in FIG. 1, vertical insertion holes 33 for the terminal support walls 18 of the connector housing 1 are formed in the upper wall portion 29 intermediate the opposite ends thereof. Guide walls 34 are provided at sides of the insertion holes 33, and an upper end 34*a* of the guide wall 34 projects upwardly beyond the upper wall portion 29, and is offset toward the partition wall 28.

Figure 6:
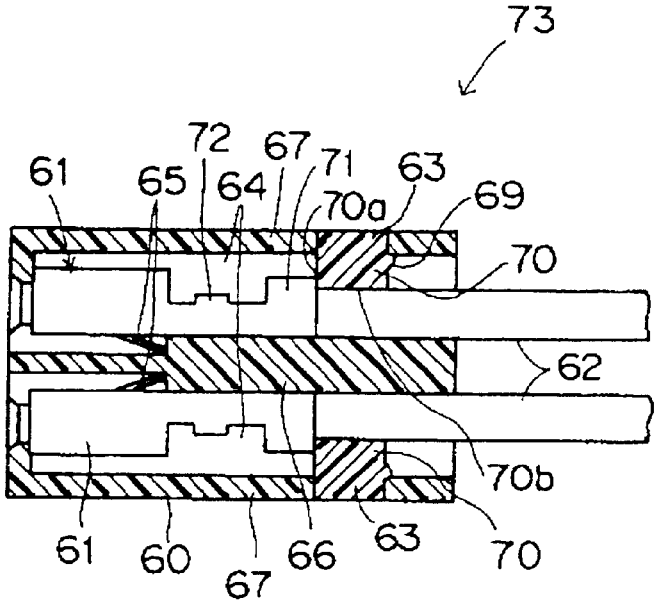
Fig. 6 PRIOR ART
FIG. 6 is a vertical cross-sectional view of the related structure in its assembled condition.

The upper surface of the base wall portion 27 are raised or projected at the opposite sides of the front portion of each terminal receiving portion 31 to form projected portions 35 and 36 which are slightly slanting upwardly. Front ends 35*a* and 36*a* of the projected portions 35 and 36 lie flush with the front end of the base wall portion 27. Similar projected portions 37 and 38 are formed on the upper wall portion 29, and are disposed above the projected portions 35 and 36, respectively. Front ends 37*a* and 38*a* of the projected portions 37 and 38 lie flush with the front end of the upper wall portion 29. Rear step portions 40 of the terminals 6 (FIG. 6) are retained by the front ends 35*a* to 38*a* of the projected portions 35 to 38.

The opposite side plate portions 30 of the spacer 7 project upwardly beyond the upper wall portion 29, and a provisionally-retaining arm 41 for the provisionally-retaining projection 21 of the connector housing 1 is formed at an upper portion of each side plate portion 30 at the rear end thereof, and a completely-retaining projection 43 for the completely-retaining projection 22 is formed at a lower portion of the side plate portion 30 at the rear end thereof. That portion of the rear end of the side plate portion 30, lying between the arm 41 and the projection 43, is extended slightly rearwardly via a slanting step portion 55 (FIG. 2).

The arm 41 has a rearwardly-directed claw 42, and a slit-like flexure space 44 is provided at the front side of the arm 41. The claw 42 has an upwardly-directed slanting surface 42*a* and a downwardly-directed horizontal engagement surface 42*b*, and the projection 43 has front and rear slanting surfaces 43*a*. The arm 41 is disposed slightly forwardly of the projection 43.

The front holder 25 is integrally connected to the front end of the base wall portion 27 of the spacer 7 through a flexible connecting piece portion 45. Thanks to the provision of this integral connecting piece portion 45, the parts (7 and 25) are prevented from being dropped and lost, and besides the assembling and disassembling operations are simplified. A groove 49 for receiving the connecting piece portion 45 is formed in the bottom wall 2' of the connector housing 1.

The front holder 25 has short receiving portions 46 which correspond respectively to the terminal receiving portions 4 and 5 in the connector housing 1, and can receive the front end portions of the terminals 6, respectively. Insertion holes 47, communicating respectively with the receiving portions 46, are formed in the front holder 25. The front holder 25 is fitted into the front opening 24 in the connector housing 1, and is fixed to the peripheral edge of the opening 24 by a retaining portion 48 formed on the outer peripheral surface of the front holder 25.

Because of the provision of the front holder 25, the opening 24 of a large size is formed in the front end of the connector housing 1, and therefore the resin-molding of the connector housing 1 (that is, the removal of the molded connector housing from a mold) is simplified, and the wire receiving portions 13 and 14 of a complicated, stepped configuration, the exposed wall portion 12*a*, terminal support portions 18 and retaining projections 21 and 22 can be formed.

Figure 3:
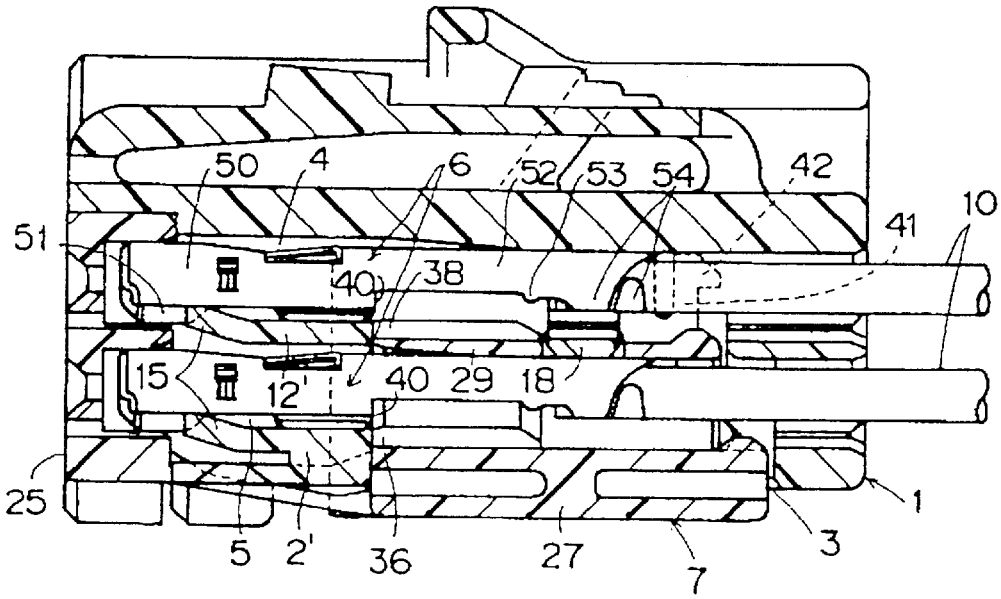
FIG. 3 is a vertical cross-sectional view of the connector, showing the spacer in its provisionally-retained condition.

As shown in FIG. 3, the front holder 25 is fitted in the connector housing, and the spacer 7 is provisionally retained on the connector housing 1. In this condition, the terminals 6, each connected to the wire, are inserted respectively into the terminal receiving portions 4 and 5 in the connector housing 1 from the rear side thereof, and are primarily retained by the retaining lances 15, respectively. The spacer 7 is not fully inserted or pushed into the connector housing, and projects slightly downwardly from the opening 3.

The terminal 6 is of the female type having a box-like electrical contact portion 50. The front end of the retaining lance 15 abuts against a step portion 51 formed at a front end portion of the electrical contact portion 50, thereby primarily retaining the terminal 6. A connecting portion 52 extends rearwardly from the electrical contact portion 50 via a step portion, and conductor-clamping piece portions 53 of a smaller size and sheath-clamping piece portions 54 of a larger size, which clamp the wire 10, are provided rearwardly of the connecting portion 52. A contact spring piece (not shown) is received within the electrical contact portion. The terminals 6 are inserted in the respective terminal receiving portions, with their backs facing upwardly.

During the insertion of the terminal 6, the electrical contact portion (that is, the front end portion) 50 of the terminal is inserted along the support wall 18 of the connector housing 18, and therefore the terminal 6 is prevented from dropping into the large opening 3 provided at the central portion of the upper terminal receiving chamber 4, and therefore the terminal 6 can be smoothly and positively inserted into the terminal receiving portion 4. After the terminal is inserted, the sheath-clamping piece portions 54 of the terminal 6 are supported by the terminal support portion 18, thereby preventing the terminal 6 from dropping in the provisionally-retained condition of the spacer 7. Also, during the time when the spacer 7 is shifted from the provisionally-retained position to the completely-retaining position, the dropping of the upper terminal 6 into the opening 3 due to vibrations and so on, developing at this time, is prevented. The lower terminals 6 are prevented by the base wall portion 27 of the spacer 27 from dropping into the opening 3 during and after the insertion of these terminals.

For provisionally retaining the spacer 7, the claw 42 of each provisionally-retaining arm 41 (FIG. 1), slides over the provisionally-retaining projection 21 (FIG. 1) on the connector housing 1, and is brought into engagement with the upper surface of this projection 21, and at the same time each completely-retaining projection (lower projection) 43 is brought into contact with the lower slanting surface 22*a* of the completely-retaining projection 22 (FIG. 1). As a result, the spacer 7 is provisionally retained against upward and downward movement. The projections 35 and 36 at the front end of the base wall portion 27 lie generally flush with the bottom wall 2', and the projections 37 and 38 at the front end of the upper wall portion 29 lie generally f lush with the bottom wall 12', and therefore the terminals 6 can be inserted without interference with the spacer 7.

When the base wall portion 27 of the spacer 7 is pushed or pressed upwardly with a relatively large force, the spacer 7 is completely inserted into the opening 3 in the connector housing 1, and therefore is completely retained as shown in FIG. 4. At this time, each completely-retaining projection 43 (FIGS. 1 and 2) of the spacer 7 slides over the completely-retaining projection 22, and is brought into engagement with the upper surface 22*b*.

When the spacer 7 is completely retained, the upper and lower wire-pressing projections 8 and 9 of the spacer 7 respectively press those portions of the wires 10 disposed adjacent to (that is, slightly rearwardly of) the sheath-clamping piece portions 54 of the upper and lower terminals 6. The lower wires 10 are pressed against the lower surface of the front step wall portion 12*a* of the bottom wall (the upper wall of the lower wire receiving portions 14) 12 of the upper wire receiving portion 13, and the upper wires 10 are pressed against the lower surface of the front extension portion 11*a* of the upper wall (wall portion) 11 of the upper wire receiving portions 13.

Each of the projections 8 and 9 is strongly pressed particularly at its top surface 8*c*, 9*c* of a small area against the insulating sheath of the wire 10, and partially compresses and recesses the insulating sheath, so that the distal end of the projection 8, 9 is held in biting engagement with the insulating sheath. The contact of the projection 8, 9 is generally a point contact rather than a surface contact. As a result, the pressing force, applied to the wire 10, is less liable to be dispersed, and therefore the wire 10 is strongly pressed against the wall portion 11, 12, thereby preventing the shaking and displacement of the wire 10 due to vibrations during the travel of a vehicle and also due to the pulling and bending of the wire 10. Therefore, the terminals 6 will not be shaken and displaced, and therefore are held in position, and wear of the mutually-connected male and female terminals, as well as the improper contact between them, is prevented.

Each projection 8, 9 is smoothly brought into contact with the wire 10 because of the provision of the front and rear tapering slanting surfaces 8*a* and 8*b*, 9*a* and 9*b*. The front and rear slanting surfaces 8*a* and 8*b*, 9*a* and 9*b* are pressed against the insulating sheath, and therefore an undue force will not be applied to the insulating sheath, thereby preventing damage to the insulating sheath. In the related structure (FIG. 6), the edges of the projected wall portion 70 are pressed against the insulating sheath, and therefore there is a possibility that the insulating sheath is damaged. In this embodiment, however, the projection 8, 9 has no edge for being pressed against the insulating sheath, and aging damage and deterioration of the insulating sheath are prevented.

The upper wire receiving portions 13 and the lower wire receiving portions 14 for respectively receiving the wires 10 are different in length from each other, and are arranged in a stepped manner, and similarly the upper and lower portions of the spacer are arranged in a stepped manner. With this construction, the upper and lower wires 10 can be simultaneously pressed by one spacer 7 in the same direction.

In the completely-retained condition of the spacer 7, the upper and lower terminals 6 are secondarily retained by the spacer 7. More specifically, the rear step portions 40 of the electrical contact portions 50 of the terminals 6 are retained respectively by the projected portions 35 to 38 (FIG. 2) formed at the front ends of the base wall portion 27 and upper wall portion 29 of the spacer 7. The projections 35 and 36 (37 and 38) abut respectively against the widthwise opposite side portions of the rear step portion 40 of the electrical contact portion 50. Therefore, the terminal 6 is firmly retained secondarily, thereby positively preventing the terminal 6 from rearward withdrawal. The connector housing 1, the spacer 7, the front holder 25 and the terminals 6 jointly form the connector 56 of the male type.

In the above embodiment, the terminals 6 are received in two (upper and lower) rows (stages) in the connector housing, and the upper and lower rows of wires 10 are simultaneously pressed. However, terminal receiving chambers (not shown) can be arranged in three (upper, middle and lower) or more rows, in which case an opening (spacer receiving portion) has a stair-like configuration (having three or more stages), and similarly a spacer (not shown) has a stair-like configuration (having three or more stages). In this case, three or more rows of wires can be pressed simultaneously by the spacer. The wire-pressing projections of the spacer and the stepped wire receiving portion in the opening in the connector housing can be applied to a connector employing no front holder.

As described above, in the present invention, by inserting the spacer into the connector housing, the plurality of rows (stages) of wires, each having the terminal, can be pressed simultaneously by the single spacer. Therefore, there is no need to use two spacers as in the related construction, and the number of the component parts, as well as the time and labor for the assembling operation, is reduced. And besides, only one spacer is required, and therefore is not necessary to arrange the upper and lower rows of terminals back to back with each other as in the related construction, and the terminals can be received in the connector housing in such a manner that the terminals face in the same direction, and therefore the connector can be formed into a multi-pole design. In the related construction, the wire is pressed by the flat wall portion of the spacer, whereas in the present invention, the wire is pressed by the projection on the spacer, and therefore the wire is pressed hard against the wall portion of the wire receiving portion, thereby positively preventing the shaking of the wire due to vibrations of the vehicle and so on. Therefore, wear of the mutually-connected terminals, as well as the improper contact between them, can be positively prevented.

In the present invention, when the spacer is inserted into the connector housing, the first row (stage) of wires are pressed against the step wall portion by the first row (stage) of wire-pressing projections, respectively, and at the same time the second row of wires are pressed against the wall portion by the second row of projections, and therefore each row of wires are prevented from shaking. Therefore, in the type of connector for receiving the terminals in two (upper and lower) rows, the number of the component parts, as well as the time and labor for the assembling operation, is reduced, and the terminals are arranged to face in the same direction, and the upper and lower wires are positively pressed by the projections, and therefore are prevented from shaking. In the present invention, the upper and lower rows of terminals are simultaneously retained respectively by the upper and lower projected portions formed on the spacer. The wire-pressing projections and the terminal-retaining projected portions are formed on the spacer separately from each other, and therefore the functions of these projections and projected portions can be performed accurately, and particularly the pressing of the wires can be effected positively. In the present invention, when each of the projections is pressed against the wire, the slanting surfaces or arcuate surface of the projection is held in contact with the wire, and therefore damage and aging damage of the wire are prevented. In the present invention, each terminal is stably supported by the terminal support portion within the spacer receiving portion, and therefore the terminal will not be dropped into the spacer receiving portion by vibrations and so on developing during the insertion of the spacer, and the spacer can be positively connected to the connector housing.

What is claimed is:

1. A wire shaking prevention structure of a connector in which terminals, respectively connected to wires, are inserted in a plurality of rows into a connector housing of the connector, and a spacer is inserted into the connector housing to effect retainment of the terminals and pressing of the wires simultaneously, the structure comprising:

a plurality of rows of wire receiving portions formed in the connector housing, the wire receiving portions being arranged in a stepped manner in a direction of length of the wires;

a plurality of rows of wire-pressing projections formed on the spacer, the rows of wire-pressing projections being offset from each other in the direction of the length of the wires; and a corresponding wall portion of the connector housing extending from a corresponding row of the wire receiving portions, wherein each row of the wires is pressed against the corresponding wall portion by a corresponding row of the projections.

2. A wire shaking prevention structure of a connector according to claim 1, wherein a first row of the wire receiving portions is provided at an inlet side of a spacer receiving portion formed in the connector housing, and a second row of the wire receiving portions is provided at an inner side of the spacer receiving portion, and is longer than the first row of the wire receiving portions, and a first row of the projections is opposed to a step wall portion formed between the first and second rows of the wire receiving portions, and a second row of the projections is opposed to the wall portion extending from the second row of the wire receiving portions.

3. A wire shaking prevention structure of a connector according to claim 2, wherein the first row of the projections is formed on a base wall portion of the spacer, and a plurality of terminal receiving portions are formed in the spacer, and are offset from the first row of the projections in the direction of the length of the wires, and the second row of the projections is formed on an outer wall portion of the terminal receiving portions.

4. A wire shaking prevention structure of a connector according to claim 3, wherein a plurality of terminal-retaining projected portions are formed on the base wall portion and the outer wall portion.

5. A wire shaking prevention structure of a connector according to claim 1, wherein each of the projections has one of a plurality of slanting surfaces and an arcuate surface for preventing damage to the wires.

6. A wire shaking prevention structure of a connector according to claim 2, wherein each of the projections has one of a plurality of slanting surfaces and an arcuate surface for preventing damage to the wires.

7. A wire shaking prevention structure of a connector according to claim 3, wherein each of the projections has one of a plurality of slanting surfaces and an arcuate surface for preventing damage to the wires.

8. A wire shaking prevention structure of a connector according to claim 4, wherein each of the projections has one of a plurality of slanting surfaces and an arcuate surface for preventing damage to the wires.

9. A wire shaking prevention structure of a connector according to claim 2, wherein a terminal support portion is provided within the spacer receiving portion of the connector housing.

10. A wire shaking prevention structure of a connector according to claim 3, wherein a terminal support portion is provided within the spacer receiving portion of the connector housing.

11. A wire shaking prevention structure of a connector according to claim 4, wherein a terminal support portion is provided within the spacer receiving portion of the connector housing.

12. A wire shaking prevention structure of a connector according to claim 5, wherein a terminal support portion is provided within the spacer receiving portion of the connector housing.

13. A wire shaking prevention structure of a connector according to claim 6, wherein a terminal support portion is provided within the spacer receiving portion of the connector housing.

14. A wire shaking prevention structure of a connector according to claim 7, wherein a terminal support portion is provided within the spacer receiving portion of the connector housing.

15. A wire shaking prevention structure of a connector according to claim 8, wherein a terminal support portion is provided within the spacer receiving portion of the connector housing.

* * * * *